US009259929B2

(12) United States Patent
Hanagami

(10) Patent No.: US 9,259,929 B2
(45) Date of Patent: Feb. 16, 2016

(54) LIQUID EJECTING APPARATUS AND CONTROL METHOD OF LIQUID EJECTING HEAD

(71) Applicant: Seiko Epson Corporation, Tokyo (JP)

(72) Inventor: Taiki Hanagami, Matsumoto (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 13/724,262

(22) Filed: Dec. 21, 2012

(65) Prior Publication Data

US 2013/0162708 A1 Jun. 27, 2013

(30) Foreign Application Priority Data

Dec. 26, 2011 (JP) ..... 2011-284534

(51) Int. Cl.

| | |
|---|---|
| ***B41J 2/045*** | (2006.01) |
| ***B41J 2/14*** | (2006.01) |
| ***B41J 2/07*** | (2006.01) |
| ***B41J 2/055*** | (2006.01) |

(52) U.S. Cl.

CPC ..... *B41J 2/14233* (2013.01); *B41J 2/04563* (2013.01); *B41J 2/04581* (2013.01); *B41J 2/04588* (2013.01); *B41J 2/055* (2013.01); *B41J 2/072* (2013.01); *B41J 2002/14241* (2013.01); *B41J 2202/03* (2013.01)

(58) Field of Classification Search

USPC ..... 347/68–75, 9, 10, 11, 12

See application file for complete search history.

(56) References Cited

U.S. PATENT DOCUMENTS

| | | | | |
|---|---|---|---|---|
| 4,126,867 | A | 11/1978 | Stevenson, Jr. | |
| 4,897,665 | A * | 1/1990 | Aoki | 347/10 |
| 4,980,699 | A * | 12/1990 | Tanabe et al. | 347/14 |
| 5,576,745 | A * | 11/1996 | Matsubara | 347/14 |
| 6,074,033 | A * | 6/2000 | Sayama et al. | 347/10 |
| 6,109,716 | A * | 8/2000 | Takahashi | 347/11 |
| 6,322,189 | B1 * | 11/2001 | Anderson | B41J 2/04528 347/17 |
| 7,377,612 | B2 * | 5/2008 | Uji | B41J 2/04528 347/17 |
| 7,651,203 | B2 * | 1/2010 | Yamada et al. | 347/68 |
| 7,744,197 | B2 * | 6/2010 | Yamada et al. | 347/68 |
| 7,887,151 | B2 | 2/2011 | Yamada et al. | |
| 2004/0084994 | A1 | 5/2004 | Iwashita et al. | |
| 2005/0062802 | A1 | 3/2005 | Kawamura | |
| 2007/0008388 | A1 | 1/2007 | Yamaguchi et al. | |
| 2009/0243438 | A1 | 10/2009 | Hamada et al. | |
| 2010/0045755 | A1 * | 2/2010 | Kobayashi | 347/86 |
| 2011/0228021 | A1 * | 9/2011 | Kobayashi et al. | 347/93 |

FOREIGN PATENT DOCUMENTS

| | | | |
|---|---|---|---|
| CN | 101552317 | A | 10/2009 |
| JP | 07-025012 | | 1/1995 |
| JP | 2003-309302 | A | 10/2003 |
| JP | 2004-006722 | | 1/2004 |
| JP | 2004-338326 | A | 12/2004 |
| JP | 2005-246656 | A | 9/2005 |
| JP | 2011-255024 | A | 12/2011 |

OTHER PUBLICATIONS

Extended European Search Report for Application No. EP 12 19 8764; mailed Apr. 3, 2013; (5 pages).

* cited by examiner

*Primary Examiner* — Matthew Luu
*Assistant Examiner* — Lily Kemathe
(74) *Attorney, Agent, or Firm* — Harness, Dickey & Pierce, P.L.C.

(57) ABSTRACT

A liquid ejecting apparatus includes: a piezoelectric element equipped with a piezoelectric layer contained a barium titanate-based complex oxide and electrodes that are provided in the piezoelectric layer; a temperature detection unit that detects temperatures; and a polarization unit that supplies a repolarization waveform to repolarize the piezoelectric layer to the piezoelectric element in the case where the temperature detection unit detects a predetermined temperature condition.

14 Claims, 6 Drawing Sheets

LIQUID EJECTING APPARATUS AND CONTROL METHOD OF LIQUID EJECTING HEAD

The entire disclosure of Japanese Patent Application No. 2011-284534, filed Dec. 26, 2011 is incorporated by reference herein.

BACKGROUND

1. Technical Field

The present invention relates to liquid ejecting apparatuses equipped with a piezoelectric element that includes electrodes and a piezoelectric layer to generate a change in pressure of a pressure generation chamber communicating with a nozzle opening, and also relates to control methods of liquid ejecting heads.

2. Related Art

As a typical example of liquid ejecting heads mounted in liquid ejecting apparatuses, there is provided an ink jet recording head, for example, in which a part of a pressure generation chamber that communicates with a nozzle opening for discharging ink droplets is configured with a vibrating plate, and this vibrating plate is deformed by a piezoelectric element and pressurizes ink in the pressure generation chamber so as to discharge the link through the nozzle opening as an ink droplet.

As a piezoelectric element used in a liquid ejecting head, there is provided such an element that is configured by sandwiching a piezoelectric material which has an electromechanical conversion function, for example, a piezoelectric layer made of a crystallized dielectric material, between two electrodes. Such piezoelectric element is mounted in a liquid ejecting head as a flexural vibration-mode actuator, for example. Note that, as a typical example of the liquid ejecting head, there exists an ink jet recording head, for example, in which a part of a pressure generation chamber that communicates with a nozzle opening for discharging ink droplets is configured with a vibrating plate, and this vibrating plate is deformed by the piezoelectric element and pressurizes ink in the pressure generation chamber so as to discharge the ink through the nozzle opening as an ink droplet.

A piezoelectric material that is used as a piezoelectric layer constituting such piezoelectric element is required to have an excellent piezoelectric characteristic, and as a typical piezoelectric material, lead zirconate titanate (PZT) can be cited. However, in view of an environmental problem, a piezoelectric material without containing lead or a piezoelectric material whose lead content is suppressed has been required. As a piezoelectric material without lead, for example, a material having a bismuth titanate-based perovskite crystal structure is proposed (for example, see JP-A-2004-6722).

However, there has been a problem that such piezoelectric layer made of a complex oxide without lead or with a suppressed lead content, in particular, a barium titanate-based piezoelectric material depends on an operational ambient temperature in terms of characteristics so that its displacement amount fluctuates largely depending on the operational ambient temperature.

Of course, not only the ink jet recording head, but also other types of liquid ejecting heads that discharge a liquid other than ink have the same problem; in addition, the same problem also occurs in piezoelectric elements that are used in other apparatuses than the liquid ejecting head.

SUMMARY

An advantage of some aspects of the invention is to provide a liquid ejecting apparatus and a control method of a liquid ejecting head that are environment-friendly and less ambient temperature-dependent.

A liquid ejecting apparatus according to an aspect of the invention includes a piezoelectric element equipped with a piezoelectric layer that is made of a barium titanate-based complex oxide and electrodes that are provided in the piezoelectric layer, and a temperature detection unit that detects temperatures; and in the case where the temperature detection unit detects a predetermined temperature condition, a repolarization waveform to repolarize the piezoelectric layer is supplied to the piezoelectric element.

According to this aspect of the invention, by applying the repolarization waveform to a piezoelectric layer that is depolarized because of its temperature being out of a predetermined temperature range so as to polarize the piezoelectric layer, it is possible to preferably maintain an appropriate displacement characteristic and to decrease the ambient temperature-dependency.

It is preferable for the polarization unit to supply the repolarization waveform to the piezoelectric element at a startup time of the apparatus. Through this, because the polarization is performed at the startup time of the apparatus regardless of the temperature history during the stop time of the apparatus, an appropriate displacement characteristic can be maintained.

It is preferable that the predetermined temperature condition be a condition in which a temperature that was out of the predetermined temperature range has returned into the predetermined temperature range. Through this, a piezoelectric layer that is depolarized because of its temperature having been out of the predetermined temperature range, is polarized after the temperature thereof has returned into the predetermined temperature range, thereby making it possible to prevent the displacement characteristic from being lowered.

It is preferable that the predetermined temperature range be a range which is defined based on a phase transition temperature. Through this, by applying the repolarization waveform to a piezoelectric layer that is depolarized because of its temperature being out of the predetermined temperature range which is set base on the phase transition temperature, it is possible to prevent the displacement characteristic of the piezoelectric layer from being lowered.

A control method according to another aspect of the invention is a control method for controlling a liquid ejecting head that includes a piezoelectric element equipped with a piezoelectric layer which is made of a barium titanate-based complex oxide and electrodes which are provided in the piezoelectric layer, the control method including polarization processing that supplies a repolarization waveform to repolarize the piezoelectric layer to the piezoelectric element in the case where a predetermined temperature condition is detected.

According to this aspect of the invention, by applying the repolarization waveform to a piezoelectric layer that is depolarized because of its temperature being out of the predetermined temperature range so as to polarize the piezoelectric layer, it is possible to preferably maintain an appropriate displacement characteristic and to decrease the ambient temperature-dependency.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Figure 1:
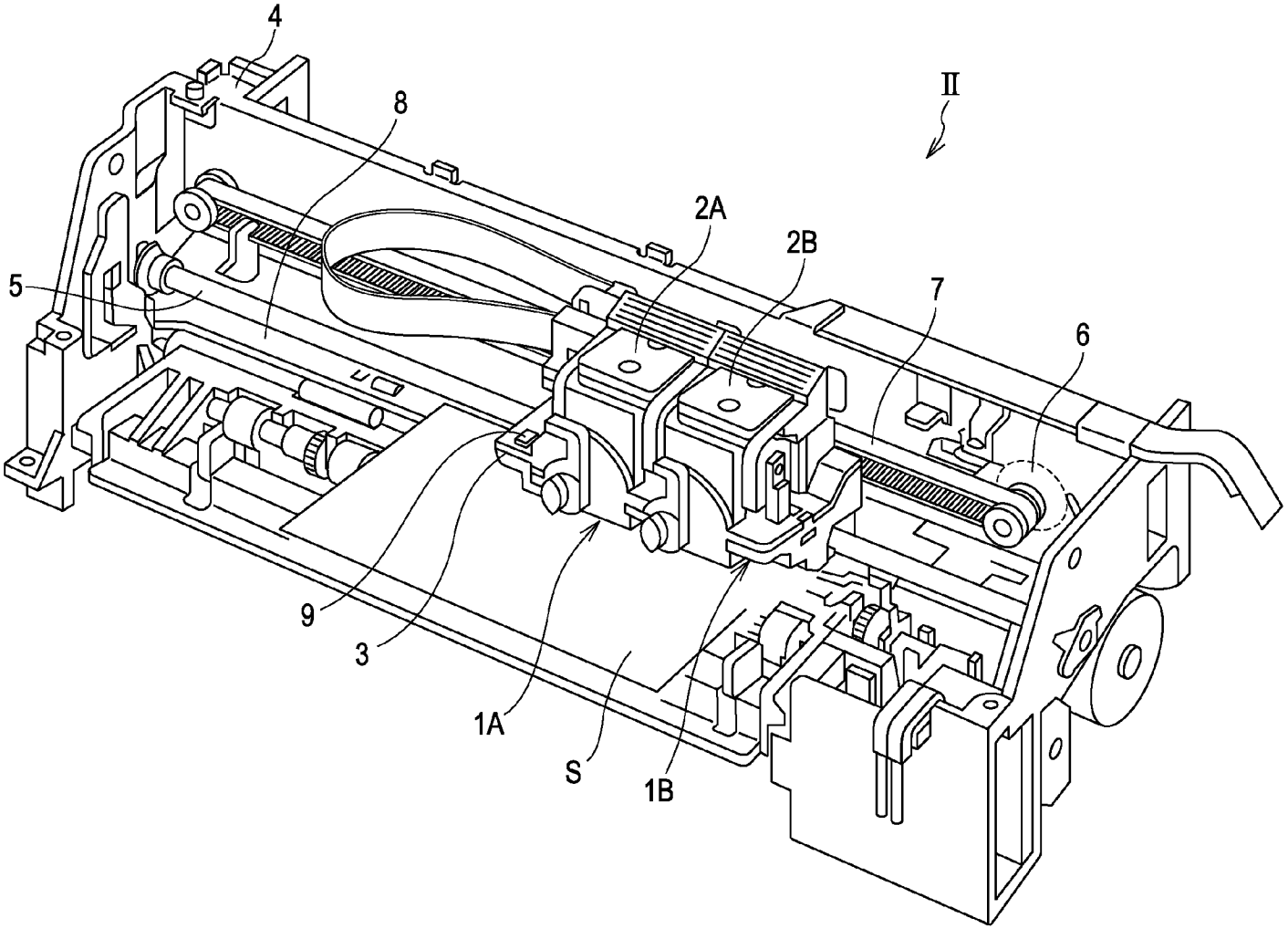
FIG. 1 is a view illustrating a general configuration of an ink jet recording apparatus according to an embodiment of the invention.

FIG. 1 is a schematic view illustrating an example of an ink jet recording apparatus as an example of the liquid ejecting apparatus according to this invention. As shown in FIG. 1, in an ink jet recording apparatus II, cartridges 2A and 2B constituting ink supply units are detachably mounted on recording head units 1A and 1B having ink jet recording heads, and a carriage 3 on which the recording head units 1A and 1B are mounted is installed on a carriage shaft 5 to be freely movable along an extension direction of the shaft; the carriage shaft 5 is attached to a main apparatus body 4. The recording head units 1A and 1B are units that discharge, for example, a black ink composition and a color ink composition, respectively.

The carriage 3 on which the recording head units 1A and 1B are mounted is moved along the carriage shaft 5 by a driving force of a driving motor 6 being transmitted to the carriage 3 via a plurality of gears (not shown) and a timing belt 7. Meanwhile, a platen 8 is provided along the carriage shaft 5 in the main apparatus body 4. A recording sheet S, which is a recording medium such as paper fed by a feed roller or the like (not shown), is wound upon the platen 8 and transported.

A temperature sensor 9 for measuring the temperature of the recording head units 1A and 1B is provided in the carriage 3 of this embodiment. In this embodiment, the temperature sensor 9 is configured of a thermistor.

Hereinafter, an ink jet recording head mounted in the ink jet recording apparatus II as described above will be described with reference to FIGS. 2 through 4. Note that FIG. 2 is an exploded perspective view illustrating a general configuration of an ink jet recording head I as an example of the liquid ejecting head according to the first embodiment, FIG. 3 is a plan view of FIG. 2, and FIG. 4 is a cross-sectional view taken along the line IV-IV in FIG. 3.

Figure 2:
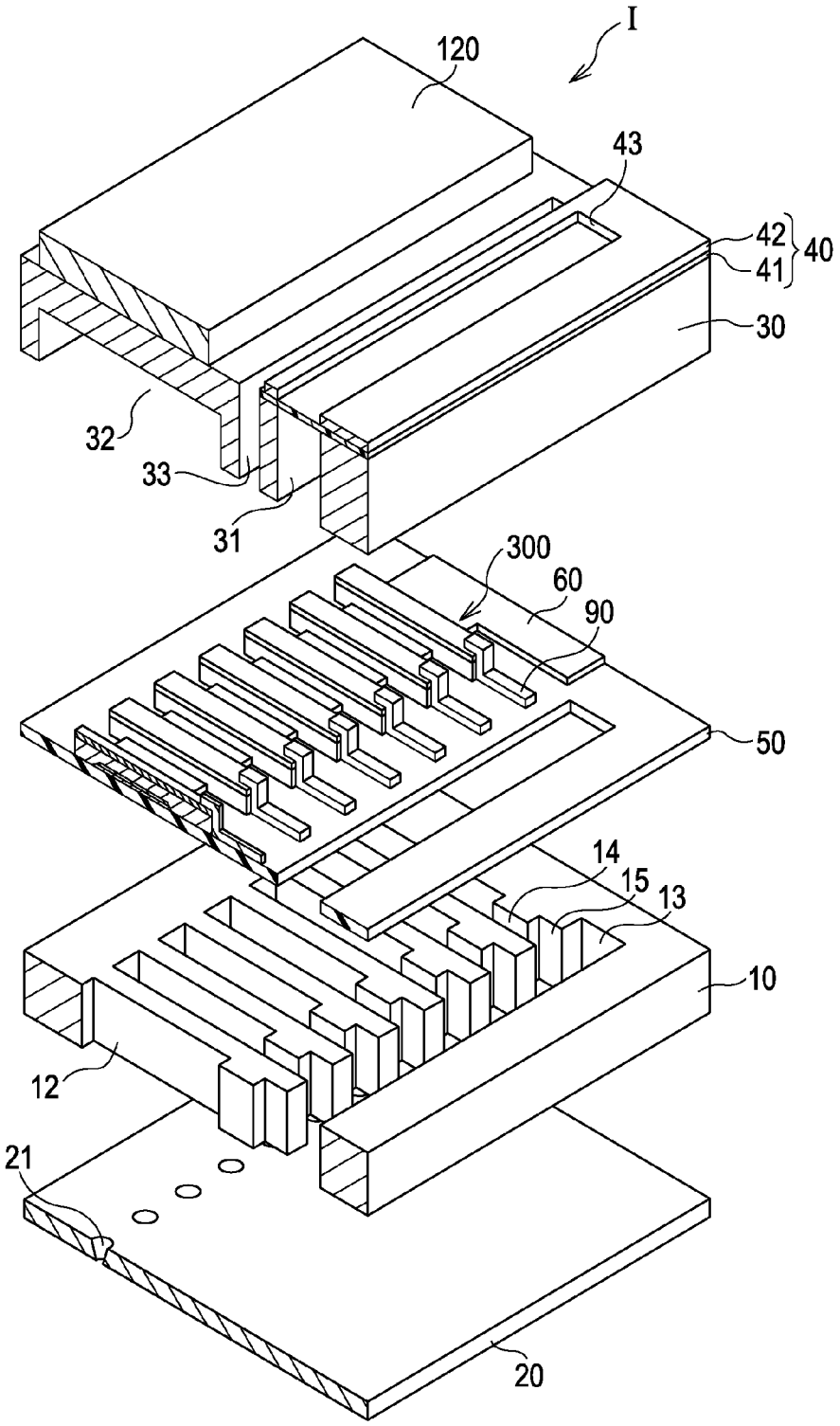
FIG. 2 is an exploded perspective view illustrating a general configuration of a recording head according to a first embodiment.
Figure 3:
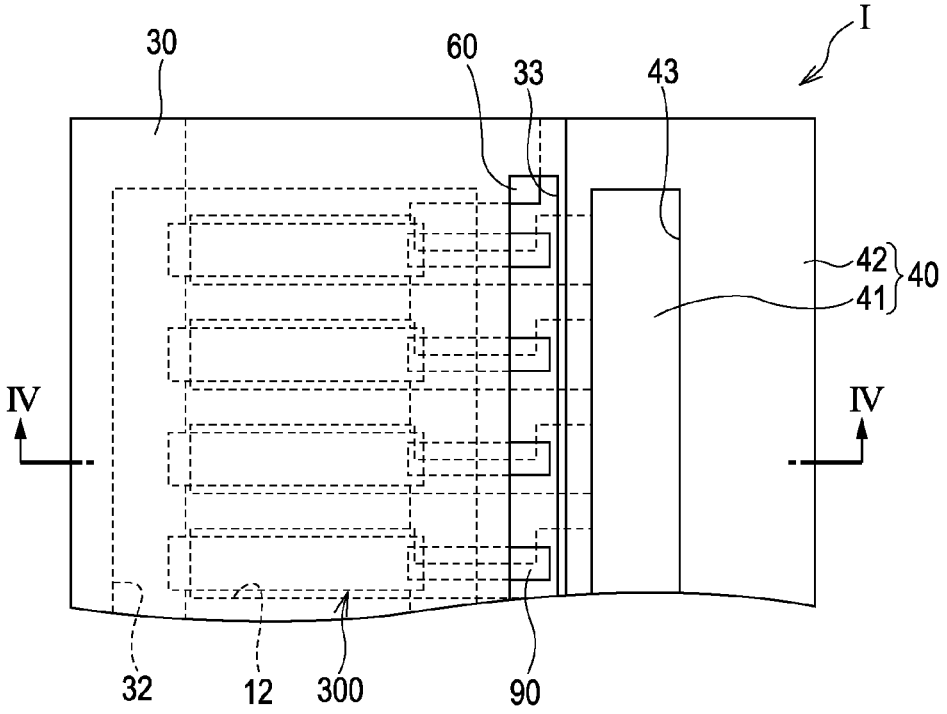
FIG. 3 is a plan view illustrating the recording head according to the first embodiment.
Figure 4:
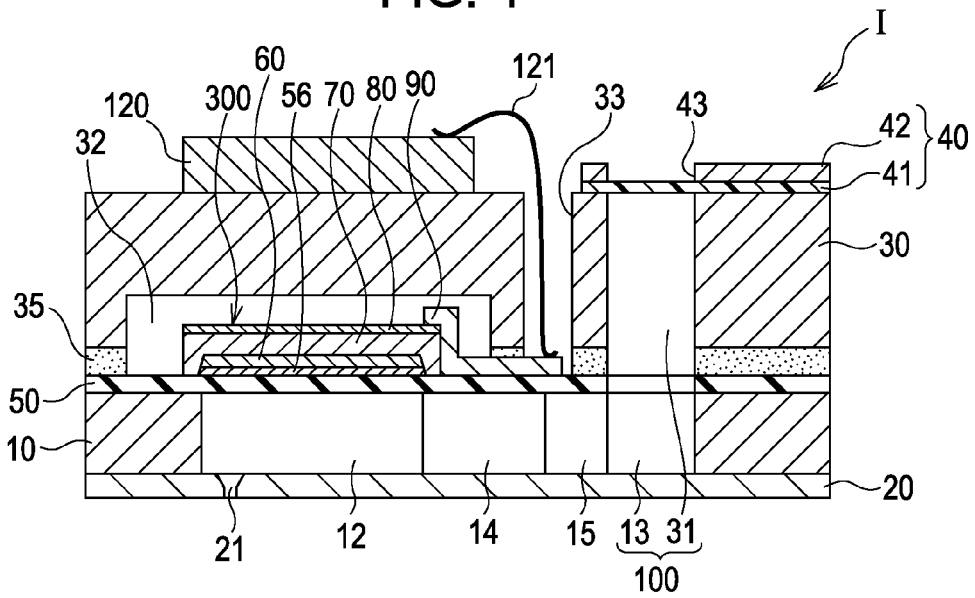
FIG. 4 is a cross-sectional view illustrating the recording head according to the first embodiment.

AS shown in FIGS. 2 through 4, a flow path forming substrate 10 of this embodiment is made of a silicon single crystal substrate, and an elastic film 50 made of silicon dioxide is formed on one surface thereof.

In the flow path forming substrate 10, a plurality of pressure generation chambers 12 are provided in parallel in the width direction of the substrate. A communication portion 13 is formed in a region outside of the pressure generation chambers 12 in the lengthwise direction thereof in the flow path forming substrate 10, and the communication portion 13 and each of the pressure generation chambers 12 communicate with each other via an ink supply path 14 and a communication path 15 that are provided for each of the pressure generation cambers 12. The communication portion 13 communicates with a manifold portion 31 in a protection substrate to be explained later and constitutes part of a manifold serving as a common ink chamber to the pressure generation chambers 12. The ink supply path 14 is formed smaller in width than the pressure generation chamber 12 and maintains the flow resistance of ink flowing into the pressure generation chamber 12 from the communication portion 13 to be constant. Although the ink supply path 14 is formed by narrowing width of the flow path from one side in this embodiment, the ink supply path 14 may be formed by narrowing the width of the flow path from both sides thereof. On the other hand, the ink supply path 14 may not be formed by narrowing the width of the flow path, but may be formed by shortening height of the flow path in the thickness direction thereof. In this embodiment, a liquid flow path configured of the pressure generation chambers 12, the communication portion 13, the ink supply paths 14 and the communication paths 15 is provided in the flow path forming substrate 10.

Further, a nozzle plate 20 is anchored to the opening face side of the flow path forming substrate 10 with an adhesive, a thermal welding film or the like. In the nozzle plate 20, there are provided nozzle openings 21 each of which communicates with the pressure generation chamber 12 at a position in the vicinity of an end of the pressure generation chamber 12 opposite to the side of the ink supply path 14. Note that the nozzle plate 20 is made of, for example, glass ceramics, a silicon single crystal substrate, stainless steel or the like.

Meanwhile, on the opposite side to the opening face side of the flow path forming substrate 10, the elastic film 50 is formed in the manner described above; on this elastic film 50, there is provided, for example, an adhesion layer 56 that is made of an approximately 30 to 50-nm thick titanium oxide or the like, and enhances the strength of adhesion between the elastic film 50 or the like and the base of a first electrode 60. Note that an insulator film made of zirconium oxide or the like may be provided on the elastic film 50 as needed.

Further, on this adhesion layer 56, the first electrode 60, a thin-film piezoelectric layer 70 having a thickness of equal to or less than 3 μm or preferably a thickness of 0.3 to 1.5 μm, and a second electrode 80 are formed being laminated so as to configure a piezoelectric element 300 as a pressure generation unit that generates a change in pressure of the pressure generation chamber 12. The piezoelectric element 300 is a component that includes the first electrode 60, the piezoelectric layer 70 and the second electrode 80. In general, one of the two electrodes of the piezoelectric element 300 is set as a common electrode, and the other one of the two electrodes and the piezoelectric layer 70 are configured in combination by patterning each of the pressure generation chambers 12. In this embodiment, the first electrode 60 is set as a common electrode of the piezoelectric element 300 and the second electrode 80 is set as an individual electrode of the piezoelectric element 300. However, it is acceptable that the first and second electrodes are set conversely for the sake of convenience of driving circuits, wiring or the like. Further, a combination of the piezoelectric element 300 and a vibrating plate that fluctuates with the driving of the piezoelectric element 300 is called an actuator. In the above example, a set of the elastic film 50, the adhesion layer 56, the first electrode 60 and the insulator film provided as needed, serves as the vibrating plate; however, the vibrating plate is not limited to the above configuration. For example, the elastic film 50 or the adhesion layer 56 may not be provided; the piezoelectric element 300 itself may additionally function as a substantial vibrating plate.

In this embodiment, the piezoelectric material configuring the piezoelectric layer 70 is made of a barium titanate-based complex oxide. Such piezoelectric material is an oxide having a perovskite structure containing titanium and barium, where part of A-site barium may be replaced with Sr, Ca or the like, or part of B-site titanium may be replaced with Zr, Hf or the like. Further, as a barium titanate-based complex oxide, aside from such type of complex oxide, where part of barium titanate, barium, titanium or the like is replaced with another element, a complex oxide, where another perovskite piezoelectric material without containing lead is dissolved in the above-mentioned type of complex oxide, is also included. As a perovskite piezoelectric material to be dissolved in barium titanate or a material in which part of barium titanate is replaced, bismuth sodium titanate-based, alkali niobium-based, and bismuth ferrate-based piezoelectric materials can be cited.

Among the piezoelectric materials used in this invention as described above, bismuth titanate, in particular, has a phase transition temperature near a range of ambient temperatures at the time of actual operation, and its displacement characteristic largely changes when the operational ambient temperature fluctuates beyond the phase transition temperature. Moreover, it has been found that the largely-changed displacement characteristic does not return to the original characteristic even if the operational ambient temperature returns into a normal range thereof. It has been also found, as the reason for this, that the above material is depolarized when a phase transition occurs with the temperature fluctuation beyond the phase transition temperature.

In this invention, a repolarization waveform is supplied to the depolarized piezoelectric layer 70 to repolarize the layer so that the displacement characteristic thereof is restored to the original characteristic, thereby preventing the print quality from being deteriorated due to an unfavorable change in the displacement characteristic.

The phase transition temperatures of a pure barium titanate are considered to be −90° C., 0° C. and 120° C., and those that are close to the actual operational ambient temperatures are 0° C. and 120° C.; 120° C. in this case is called a Curie point. However, the phase transition temperatures of the piezoelectric layer 70, which is made of a barium titanate-based complex oxide in an actually adopted composition, are estimated to be near 15° C. and 135° C.; and barium titanate is tetragonal in a range of 15° C. to 135° C. A tetragonal-to-orthorhombic phase transition takes place at below 15° C., and a tetragonal-to-cubic phase transition takes place at above 135° C.

In this embodiment, a range from equal to or greater than 15° C. to equal to or less than 135° C. is called the predetermined temperature range and considered to be a normal operation temperature range. In the case where the piezoelectric layer 70 is exposed to a temperature outside of the predetermine temperature range, since a phase transition takes place and the displacement characteristic thereof changes, it is necessary to either temporarily stop the print operation or control the temperature of the piezoelectric layer 70 to return into the predetermined temperature range when the ambient temperature is out of the predetermined temperature range. In this embodiment, such control processing is performed that temporarily stops the print operation and waits until the temperature returns into the predetermined temperature range.

When the temperature that was once out of the predetermined temperature range has returned into the predetermined temperature range, the piezoelectric layer 70 returns to be tetragonal; however, the piezoelectric layer 70 is depolarized. Accordingly, such control processing is performed that supplies a repolarization waveform so as to polarize the piezoelectric layer 70, which will be explained in detail later.

A lead electrode 90, which is made of, for example, gold (Au) or the like, is drawn out from the vicinity of an end portion at the side of the ink supply path 14 and extended to the upper side of the elastic film 50 and the upper side of the insulator film provided as needed; and finally it is connected with each of the second electrodes 80 as the individual electrode of the piezoelectric element 300.

On the upper side of the flow path forming substrate 10 in which the above-described piezoelectric element 300 is formed, in other words, on the upper side of the first electrode 60, the elastic film 50, the insulator film provided as needed and the lead electrode 90, a protection substrate 30 including the manifold portion 31 that constitutes at least part of a manifold 100 is fixed via an adhesive 35. In this embodiment, the manifold portion 31 is formed, penetrating through the protection substrate 30 in its thickness direction, across the pressure generation chambers 12 in the width direction thereof. In addition, as described earlier, the manifold portion 31 communicates with the communication portion 13 in the flow path forming substrate 10 so as to form the manifold 100 as a common ink chamber to the pressure generation chambers 12. Moreover, the communication portion 13 in the flow path forming substrate 10 may be partitioned into plural portions corresponding to each of the pressure generation chambers 12, and only the manifold portion 31 may serve as a manifold. Further, for example, only the pressure generation chambers 12 may be provided in the flow path forming substrate 10, and the ink supply path 14 that communicates the manifold 100 with each of the pressure generation chambers 12 may be provided in a member interposed between the flow path forming substrate 10 and the protection substrate 30 (for example, the elastic film 50, the insulator film provided as needed or the like).

A piezoelectric element support portion 32 having a space of a size that will not obstruct movement of the piezoelectric element 300, is provided in a region of the protection substrate 30 opposing to the piezoelectric element 300. It is sufficient that the piezoelectric element support portion 32 has a space of a size that will not obstruct the movement of the piezoelectric element 300, and it does not matter whether the space is hermetically-sealed or not.

It is preferable for the above-described protection substrate 30 to use a material whose coefficient of thermal expansion is approximately the same as that of the flow path forming substrate 10, such as glass, ceramics material or the like; and in this embodiment, it is formed using a silicon single crystal substrate, which is the same material as that of the flow path forming substrate 10.

A through-hole 33 is provided in the protection substrate 30 penetrating through the protection substrate 30 in its thickness direction, and the vicinity of an end of the lead electrode 90 drawn out from each of the piezoelectric elements 300 is so arranged as to be exposed to the interior of the through-hole 33.

A driving circuit 120 for driving the piezoelectric elements 300 arranged in parallel is anchored to the protection substrate 30. As the driving circuit 120, a circuit board, a semiconductor integrated circuit (IC) or the like can be used, for example. The driving circuit 120 and the lead electrode 90 is electrically connected with each other via a connecting wire 121 which is made of a conductive wire such as a bonding wire or the like.

A compliance substrate 40 configured of a sealing film 41 and a fixing plate 42 is bonded to the upper side of the protection substrate 30. The sealing film 41 is made of a flexible material having low rigidity, and one surface side of the manifold portion 31 is sealed with this sealing film 41. The fixing plate 42 is formed with a relatively hard material. A region of the fixing plate 42 facing the manifold 100 is completely removed in its thickness direction so as to be an opening 43. Therefore, the one surface side of the manifold 100 is sealed with only the flexible sealing film 41.

In the ink jet recording head I according to this embodiment, ink is introduced through an ink introduction port connected with an external ink supply unit (not shown), and the interior of the manifold 100 down to the nozzle openings 21 is filled with the ink; thereafter, according to a recording signal (driving signal) sent from the driving circuit 120, voltage is applied between the first electrode 60 and the second electrode 80 corresponding to each of the pressure generation chambers 12 so as to bend and deform the elastic film 50, the adhesion layer 56, the first electrode 60 and the piezoelectric layer 70; and the pressure inside the pressure generation chamber 12 thus increases so that an ink droplet is discharged through the nozzle opening 21.

Figure 5:
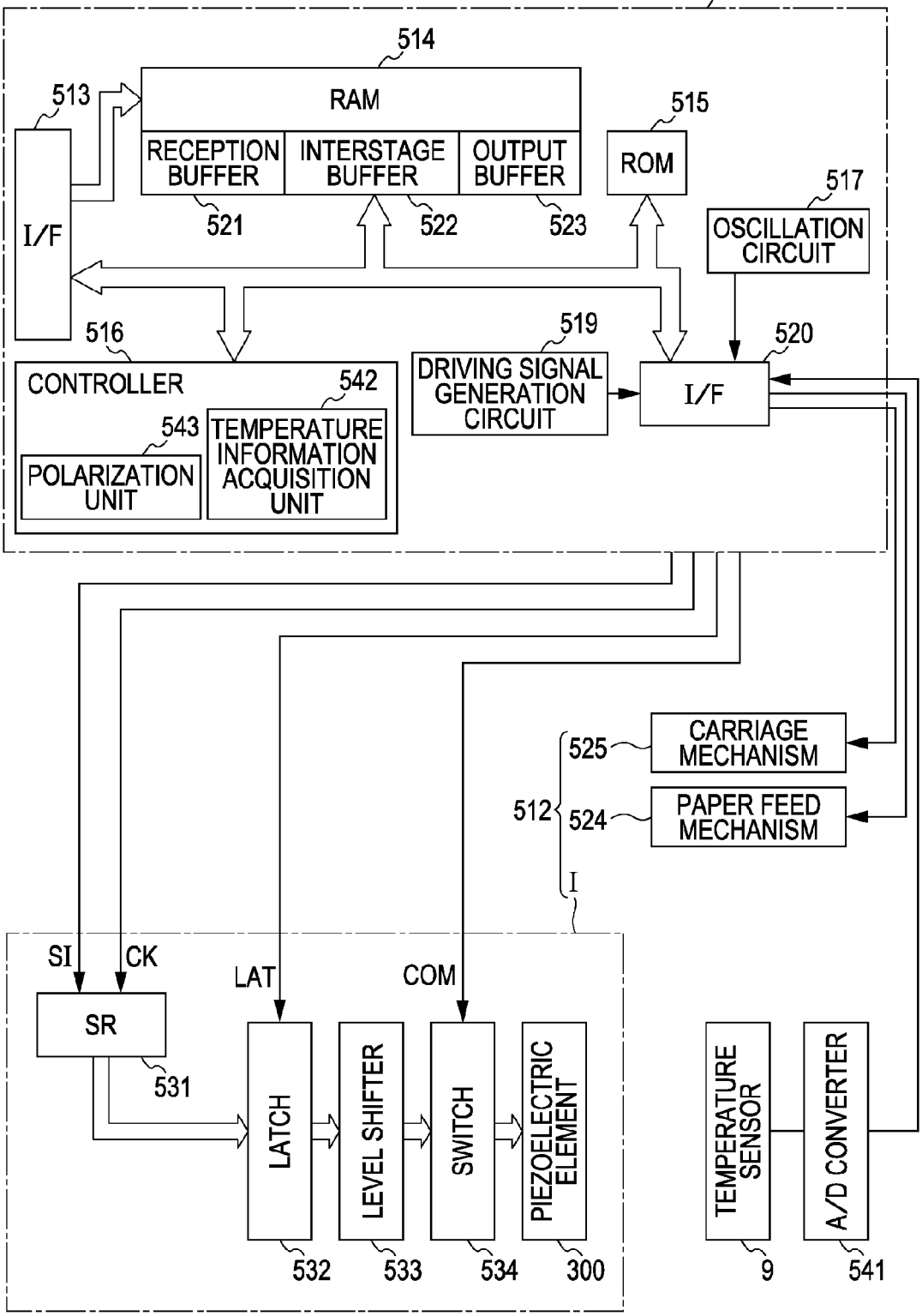
FIG. 5 is a block diagram illustrating a control configuration of an ink jet recording apparatus according to the first embodiment.

FIG. 5 is a block diagram illustrating an example of a control configuration of the ink jet recording apparatus described above. Hereinafter, the controlling of the ink jet recording apparatus according to this embodiment will be described with reference to FIG. 5. As shown in FIG. 5, the inkjet recording apparatus according to this embodiment is generally configured of a printer controller 511 and a print engine 512. The printer controller 511 includes an external interface 513 (hereinafter, referred to as an "external I/F 513"), a RAM 514 that temporarily stores various kinds of data, a ROM 515 storing a control program or the like, a controller 516 configured of a CPU and the like, an oscillation circuit 517 that generates a clock signal, a driving signal generation circuit 519 that generates a driving signal to be supplied to the ink jet recording head I, and an internal interface 520 (hereinafter, referred to as "an internal I/F 520") that sends dot-pattern data (bit-map data) which is created based on the driving signal and print data, and the like to the print engine 512.

The external I/F 513 receives print data configured of, for example, character codes, graphics functions, image data or the like from a host computer (not shown). A busy signal (BUSY), an acknowledge signal (ACK), and the like are outputted to the host computer or the like via the external I/F 513. The RAM 514 functions as a reception buffer 521, an interstage buffer 522, an output buffer 523 and a working memory (not shown). The reception buffer 521 temporarily stores the print data received by the external I/F 513, the interstage buffer 522 stores interstage code data converted by the controller 516, and the output buffer 523 stores dot-pattern data. Note that the dot-pattern data is configured of printing data obtained by decoding (translating) the tone data.

Font data, graphics functions and the like are stored in the ROM 515, in addition to the control program (control routine) for executing various kinds of data processing.

The controller 516 reads out the print data in the reception buffer 521 and stores the interstage code data obtained by converting the print data in the interstage buffer 522. In addition, the controller 516 analyzes the interstage code data read out from the interstage buffer 522, and creates the dot-pattern data from the interstage code data referring to the font data, the graphics functions and the like that are stored in the ROM 515; then, the controller 516 performs essential decoration processing on the created dot-pattern data, and thereafter stores the created dot-pattern data in the output buffer 523. Moreover, the controller 516 also functions as a waveform setting unit, in other words, it controls the driving signal generation circuit 519 to set the shape of a waveform of the driving signal outputted from the driving signal generation circuit 519. The controller 516 in combination with a driving circuit (not shown) or the like to be explained later constitutes a driving unit of the invention. Further, as a liquid ejection driving apparatus that drives the ink jet recording head I, it is sufficient to include at least this driving unit. Accordingly, in this embodiment, the driving unit includes the printer controller 511.

When one line's worth of dot-pattern data of the ink jet recording head I is obtained, this one line's worth of dot-pattern data is outputted to the ink jet recording head I via the internal I/F 520. In the case where one line's worth of dot-pattern data is outputted from the output buffer 523, the created interstage code data is erased from the interstage buffer 522, and the subsequent interstage code data is subjected to the creation processing.

The print engine 512 is configured of the ink jet recording head I, a paper feed mechanism 524, and a carriage mechanism 525. The paper feed mechanism 524 is configured of a paper feed motor, the platen 8 and the like, and feeds out print recording media such as recording sheets one after the other in cooperation with recording operation of the ink jet recording head I. In other words, the paper feed mechanism 524 relatively moves the print recording media in a sub scanning direction.

The carriage mechanism 525 is configured of the carriage 3 on which the ink jet recording head I can be mounted and a carriage driving portion that moves the carriage 3 along a main scanning direction; the movement of the carriage 3 causes the ink jet recording head I to move in the main scanning direction. Note that the carriage driving portion is configured of the driving motor 6, the timing belt 7 and the like.

The ink jet recording head I includes the multiple nozzle openings 21 along the sub scanning direction and discharges droplets through each of the nozzle openings 21 at the timing specified by the dot-pattern data or the like. Electric signals, such as a driving signal (COM) and recording data (SI) to be explained later, are supplied to the piezoelectric element 300 of the ink jet recording head I via external wiring (not shown). In the printer controller 511 and the print engine 512 configured as described above, the printer controller 511 and the driving circuit (not shown) serve as the driving unit that applies predetermined driving signals to the piezoelectric element 300; the driving circuit (not shown) includes a latch 532, a level shifter 533, a switch 534 and the like, and selectively inputs the driving signals, which are outputted from the driving signal generation circuit 519 and have the predetermined waveforms, to the piezoelectric element 300.

A shift register (SR) 531, the latch 532, the level shifter 533, the switch 534 and the piezoelectric element 300 are provided for each of the nozzle openings 21 of the ink jet recording head I, in which the shift register 531, the latch 532, the level shifter 533 and the switch 534 in cooperation generate a driving pulse from a discharge driving signal, a relaxation driving signal or the like generated by the driving signal generation circuit 519. The driving pulse is a pulse signal that is actually applied to the piezoelectric element 300.

In the ink jet recording head I, at first, in synchronization with a clock signal (CK) from the oscillation circuit 517, the recording data (SI) configuring the dot-pattern data is serial-transferred from the output buffer 523 to the shift register 531 to be set therein in series. In this case, of the printing data of the overall nozzle openings 21, the most significant bit data is serial-transferred first, and the second most significant bit data is serial-transferred after the most significant bit data having been transferred; the remaining bit data is serial-transferred in series in the order of bit significance in the same manner as described above.

When the bit data of the recording data for all the nozzle openings are set in each of the shift registers 531, the controller 516 outputs a latch signal (LAT) to the latch 532 at a predetermined timing. Upon receiving the latch signal, the latch 532 latches the printing data set in the shift register 531. Recording data (LATout) latched by the latch 532 is applied to the level shifter 533 as a voltage amplifier. In the case where the recording data is "1", for example, the level shifter 533 boosts this recording data to a voltage value capable of driving the switch 534, for example, to tens of volts. The boosted recording data is applied to each of the switches 534, and each of the switches 534 is put into a connected state by the recording data.

Meanwhile, the driving signal (COM) generated by the driving signal generation circuit 519 is also applied to each of the switches 534; and when the switch 534 is selectively put into a connected state, the driving signal is selectively applied to the piezoelectric element 300 connected with this switch 534. In the ink jet recording head I exemplified above, it is possible to control whether or not to apply the discharge driving signal to the piezoelectric element 300 in accordance with the recording data. For example, during a period of time when the recording data is "1", since the switch 534 is made to be in a connected state by the latch signal (LAT), a driving signal (COMout) can be supplied to the piezoelectric element 300, and the piezoelectric element 300 is displaced (deformed) by the supplied driving signal (COMout). On the other hand, during a period of time when the recording data is "0", since the switch is put into a disconnected state, the supply of the driving signal to the piezoelectric element 300 is blocked. Because each of the piezoelectric elements 300 holds an immediately previous potential during the period of time when the recording data is "0", the immediately previous displacement state is maintained.

Note that the above-described piezoelectric element 300 is a flexural vibration-mode piezoelectric element 300. In the case where the flexural vibration-mode piezoelectric element 300 is used, when voltage is applied to the piezoelectric layer 70, the piezoelectric layer 70 contracts in a perpendicular direction with respect to the applied voltage (a direction inward from the manifold portion 31) and causes the piezoelectric element 300 and the vibrating plate to bend toward the pressure generation chamber 12 side, thereby shrinking the pressure generation chamber 12. Meanwhile, when the voltage is lowered, the piezoelectric layer 70 extends in a direction towards the manifold portion 31 and causes the piezoelectric element 300 and the vibrating plate to bend in a direction opposite to the pressure chamber 12, thereby expanding the pressure generation chamber 12. In the ink jet recording head I described above, charging/discharging the piezoelectric element 300 causes the volume of the corresponding pressure generation chamber 12 to change, whereby a droplet can be discharged through the nozzle opening 21 by making use of the pressure fluctuation of the pressure generation chamber 12.

Hereinafter, a driving waveform representing the driving signal (COM) of this embodiment which is inputted to the piezoelectric element 300, will be described.

The driving waveform inputted to the piezoelectric element 300 is applied to the individual electrode (second electrode 80) while the common electrode (first electrode 60) being set a reference potential (Vbs in this embodiment).

In this embodiment, temperature information inputted from the temperature sensor 9 via an A/D converter 541 is stored in a memory unit by a temperature information acquisition unit 542, and the temperature sensor 9 and the temperature information acquisition unit 542 correspond to the temperature detection unit. A polarization unit 543 determines whether or not to apply the repolarization waveform to the piezoelectric element 300 based on the temperature information stored in the memory unit, and applies the repolarization waveform to the piezoelectric element 300 if needed.

Figure 6:
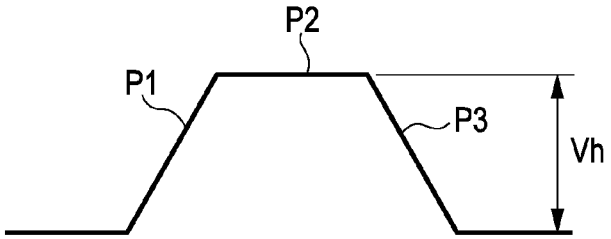
FIG. 6 is a diagram illustrating an example of a repolarization waveform.

FIG. 6 is an example of the repolarization waveform that is configured of a voltage ascending stage P1 where the voltage is raised from a reference voltage to a predetermined voltage, a voltage holding stage P2 where the predetermined voltage is held, and a voltage descending stage P3 where the voltage is lowered to the reference voltage. In the above-mentioned repolarization waveform, each stage takes a few seconds, for example, around 6 seconds; a one-cycle takes around 18 seconds, and voltage Vh is 30 to 40 volts. Therefore, it is to be noted that the polarization waveform is completely different from the driving waveform whose one-cycle is 10 to 20 μsec.

Figure 7:
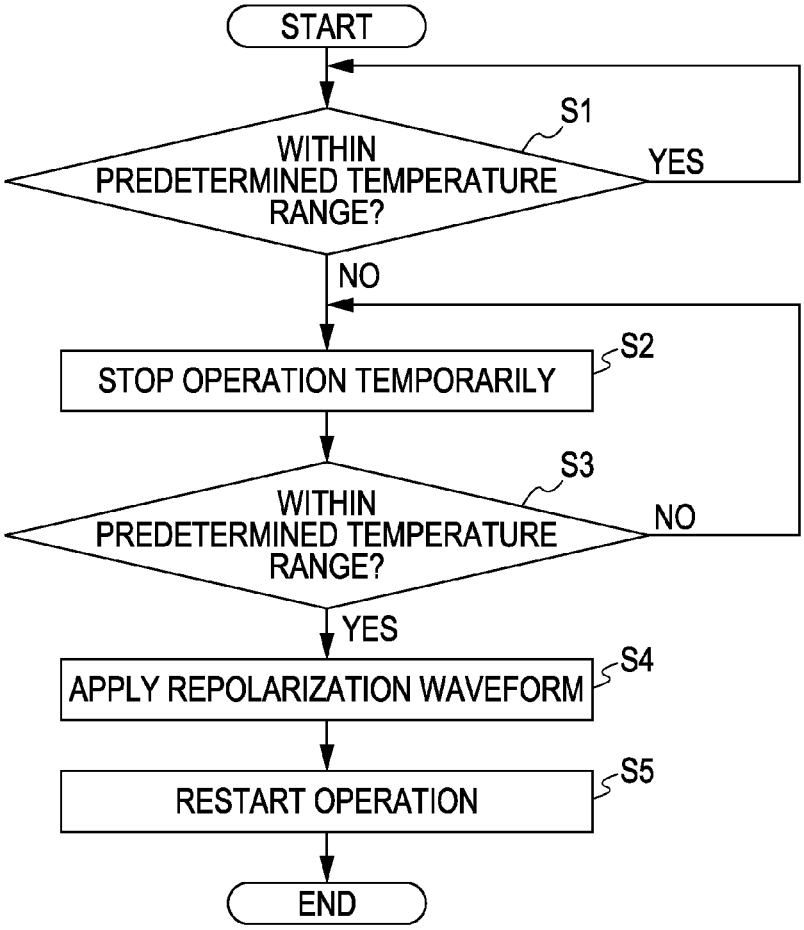
FIG. 7 is a flow diagram illustrating an example of polarization processing.

Hereinafter, an example of a polarization processing flow will be described with reference to FIG. 7. As shown in FIG. 7, the polarization unit 543 acquires the temperature information that the temperature acquisition unit 542 has stored in the memory unit, and determines whether or not the present temperature falls in a predetermined temperature range, that is, a range of equal to or greater than 15° C. to equal to or less than 135° C. in this embodiment (step S1); if it falls in the range (step S1; Yes), nothing is done. If the temperature is out of the predetermined temperature range (step S1; No), an instruction to temporarily stop the operation such as printing is sent to the controller and the operation is stopped (step S2). Thereafter, it is determined whether or not the temperature is within the predetermined temperature range (step S3); if the temperature has not returned into the predetermined temperature range (step S3; No), the operation is controlled to stand by until the temperature returns into the predetermined range. If the temperature has returned into the predetermined temperature range (step S3; Yes), an instruction to apply the repolarization waveform is sent to the controller (step S4), thereafter, the operation is restarted (step S5).

With the above flow, in the case where the piezoelectric element 300 is at a temperature outside of the predetermined temperature range, the print operation is temporarily stopped so as to prevent printing quality from being lowered due to an unfavorable change of the displacement characteristic. After this, when the temperature has returned into the predetermined temperature range, the repolarization waveform is applied to the piezoelectric element 300 to polarize it before the restart of the print operation, whereby the displacement characteristic is restored to the original displacement characteristic, and afterward an appropriate print quality can be maintained.

Moreover, upon the startup of the apparatus, it is advisable to record the temperature history before the startup time of the apparatus, and to apply the repolarization waveform if the history indicates that the temperature has been out of the predetermined temperature range. Meanwhile, it is also advisable to unconditionally apply the repolarization waveform at the startup time of the apparatus without recording the temperature history during the stop time. In this embodiment, the repolarization waveform is unconditionally applied at the startup time of the apparatus.

Figure 8:
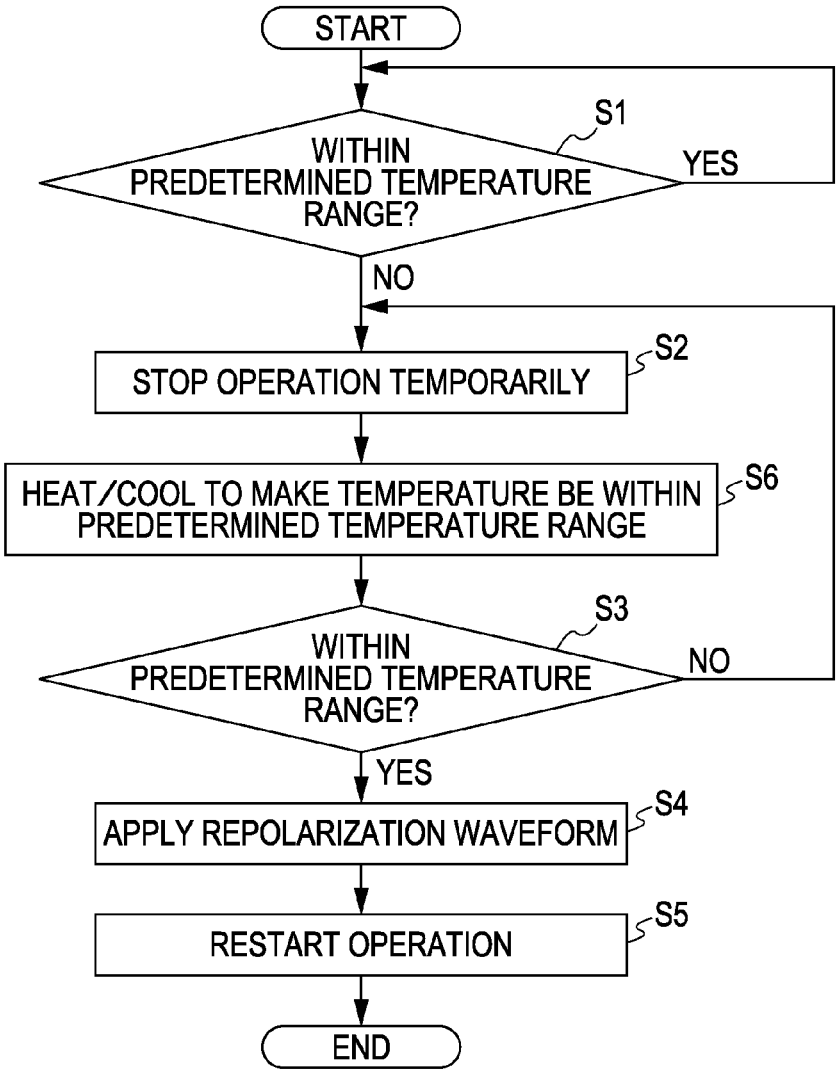
FIG. 8 is a flow diagram illustrating another example of the polarization processing.

Further, in the above-described flow, in the case where the temperature is out of the predetermined temperature range, the operation is temporarily stopped and controlled to stand by until the temperature returns into the predetermined temperature range; however, by installing a unit that heats or cools the piezoelectric element 300, it is possible to heat or cool the piezoelectric element 300 when the temperature is out of the predetermined temperature range so as to cause the temperature to return into the predetermined temperature range. An example of a processing flow in this case is illustrated in FIG. 8. The flow illustrated in FIG. 8 is basically the same as that of FIG. 7, but is different in that, when the temperature is out of the predetermined temperature range (step S1; No), an instruction to temporarily stop the operation such as printing is sent to the controller and the operation is temporarily stopped (step S2), and simultaneously the piezoelectric element 300 is heated or cooled by the heating or cooling unit so as to cause the temperature of the piezoelectric element 300 to return into the predetermined temperature range (step S6).

In the case where the heating or cooling unit described above is provided, it is advisable to heat or cool the piezoelectric element 300 at the timing when the temperature thereof is about to be out of the predetermined temperature range, so that the temperature is controlled to stay within the predetermined temperature range all the time during the operation.

Although an example of the repolarization waveform is illustrated in FIG. 6, the repolarization waveform is not limited thereto. It is needless to say that any waveform can be used as long as the piezoelectric layer 70 of the piezoelectric element 300 can be repolarized by the repolarization waveform. Moreover, as the repolarization waveforms, two different repolarization waveforms may be provided, that is, one is a waveform to be used when the temperature returns into a predetermined temperature range from a temperature lower than the predetermined temperature range, and the other one is a waveform to be used when the temperature returns into the predetermined temperature range from a temperature higher than the predetermined temperature range; and needless to say, either one of the waveforms should be selected based on the behavior of the temperature to repolarize the piezoelectric layer 70 in the optimum manner.

Other Embodiments

Thus far, the first embodiment of the invention has been described. However, the principal configuration of the invention is not limited thereto. For example, a silicon single crystal substrate is exemplified as the flow path forming substrate 10 in the above embodiment. However, the flow path forming substrate 10 is not specifically limited thereto, and a material such as an SOI substrate, glass or the like may be used.

Further, in the above embodiment, the piezoelectric element 300 in which the first electrode 60, the piezoelectric layer 70 and the second electrode 80 are laminated in series in this order on a substrate (flow path forming substrate 10) is exemplified. However, the invention is not limited thereto. For example, this invention can be also applied in a liquid ejecting apparatus equipped with a longitudinal vibration-type piezoelectric element in which a piezoelectric material and an electrode forming material are alternately laminated and the laminated materials contract or expand in the axis direction.

In the above embodiments, an ink jet recording head as an example of the liquid ejecting head and an ink jet recording apparatus as an example of the liquid ejecting apparatus are cited and explained. However, this invention is intended to be widely applied in all-around types of liquid ejecting apparatuses; and of course, the invention can be applied in liquid ejecting apparatuses that eject liquid other than ink. As other types of the liquid ejecting heads, for example, various kinds of recording heads used in image recording apparatuses such as printers, coloring material ejecting heads used in the manufacture of color filters of liquid crystal displays or the like, electrode material ejecting heads used in the formation of electrodes of organic EL displays, field emission displays (FEDs) and the like, bioorganic substance ejecting heads used in the manufacture of biochips, and the like can be cited; and the invention can be applied in the liquid ejecting apparatuses including these liquid ejecting heads.

What is claimed is:

1. A liquid ejecting apparatus comprising:

a piezoelectric element that includes a piezoelectric layer, which has a complex oxide, and that includes electrodes which sandwich the piezoelectric layer;

a temperature detection unit that detects a temperature;

a driving unit that drives the piezoelectric element by supplying a drive waveform; and a polarization unit that supplies a repolarization waveform to the piezoelectric element, wherein when the temperature detected by the temperature detection unit is in a predetermined temperature condition, the polarization unit supplies the repolarization waveform to the piezoelectric element to polarize the piezoelectric layer so that a depolarized state of the piezoelectric layer is changed to a polarized state, the repolarization waveform is different from the drive waveform, the predetermined temperature condition is when, after the temperature detected at a first time is out of a predetermined temperature range, the temperature detected at a second time is in the predetermined temperature range, and the piezoelectric element is depolarized when the temperature is out of the predetermined temperature range, and is repolarized after the repolarization waveform is supplied to the piezoelectric element.

2. The liquid ejecting apparatus according to claim 1, wherein the polarization unit supplies the repolarization waveform to the piezoelectric element at a startup time of the apparatus.

3. The liquid ejecting apparatus according to claim 1, wherein the predetermined temperature range is 15° C. through 135° C.

4. The liquid ejecting apparatus according to claim 1, wherein the predetermined temperature range is defined based on a phase transition temperature.

5. A control method for controlling a liquid ejecting head that includes a piezoelectric element, the piezoelectric element including a piezoelectric layer which has a complex oxide without lead, and the piezoelectric element including electrodes which sandwich the piezoelectric layer, the method comprising:

detecting a temperature by a temperature detection unit;

driving the piezoelectric element by supplying a drive waveform; and supplying a repolarization waveform to the piezoelectric element by a polarization unit, wherein when the temperature detected by the temperature detection unit is in a predetermined temperature condition, the polarization unit supplies the repolarization waveform to the piezoelectric element to polarize the piezoelectric layer so that a depolarized state of the piezoelectric layer is changed to a polarized state, the repolarization waveform is different from the drive waveform, the predetermined temperature condition is when, after the temperature detected at a first time is out of a predetermined temperature range, the temperature detected at a second time is in the predetermined temperature range, and the piezoelectric element is depolarized when the to is out of the predetermined temperature range, and is repolarized after the repolarization waveform is supplied to the piezoelectric element.

6. The control method according to claim 5, wherein the predetermined temperature range is 15° C. through 135° C.

7. The liquid ejecting apparatus according to claim 1, wherein the complex oxide is a barium titanate-based complex oxide.

8. A piezoelectric apparatus comprising:

a piezoelectric element that includes a piezoelectric layer having a complex oxide without lead and that includes electrodes sandwiching the piezoelectric layer;

a temperature detection unit that detects a temperature;

a driving unit that drives the piezoelectric element by supplying a drive waveform; and a polarization unit that supplies a repolarization waveform to the piezoelectric element, wherein when the temperature detected by the temperature detection unit is in a predetermined temperature condition, the polarization unit supplies the repolarization waveform to the piezoelectric element to polarize the piezoelectric layer so that a depolarized state of the piezoelectric layer is changed to a polarized state, the repolarization waveform is different from the drive waveform, the predetermined temperature condition is when, after the temperature detected at a first time is out of a predetermined temperature range, the temperature detected at a second time is in the predetermined temperature range, and the piezoelectric element is depolarized when the temperature is out of the predetermined temperature range, and is repolarized after the repolarization waveform is supplied to the piezoelectric element.

9. The piezoelectric apparatus according to claim 8, wherein the polarization unit supplies the repolarization waveform to the piezoelectric element at a startup time of the apparatus.

10. The piezoelectric apparatus according to claim 8, wherein the predetermined temperature range is 15° C. through 135° C.

11. The piezoelectric apparatus according to claim 8, wherein the predetermined temperature range is defined based on a phase transition temperature.

12. The piezoelectric apparatus according to claim 8, wherein the complex oxide is a barium titanate-based complex oxide.

13. A control method for controlling a piezoelectric apparatus that includes a piezoelectric element, the piezoelectric element including a piezoelectric layer, which has a complex oxide without lead, and the piezoelectric element including electrodes, which sandwich the piezoelectric layer, the method comprising:

detecting a temperature by a temperature detection unit;

driving the piezoelectric element by supplying a drive waveform; and supplying a repolarization waveform to the piezoelectric element by a polarization unit, wherein when the temperature detected by the temperature detection unit is in a predetermined temperature condition, the polarization unit supplies the repolarization waveform to the piezoelectric element to polarize the piezoelectric layer so that a depolarized state of the piezoelectric layer is changed to a polarized state, the repolarization waveform is different from the drive waveform, the predetermined temperature condition is when, after the temperature detected at a first time is out of a predetermined temperature range, the temperature detected at a second time is in the predetermined temperature range, and the piezoelectric element is depolarized when the temperature is out of the predetermined temperature range, and is repolarized after the repolarization waveform is supplied to the piezoelectric element.

14. The control method according to claim 13, wherein the predetermined temperature range is 15° C. through 135° C.

* * * * *